US009182132B2

(12) United States Patent
Penuel

(10) Patent No.: US 9,182,132 B2
(45) Date of Patent: Nov. 10, 2015

(54) COMBINATION DOMESTIC APPLIANCE MOUNTING SYSTEM WITH SERVICE CAPABILITY

(71) Applicant: BSH Home Appliances Corporation, Irvine, CA (US)

(72) Inventor: Michael Penuel, Swansboro, NC (US)

(73) Assignee: BSH Home Appliances Corporation, Irvine, CA (US)

( * ) Notice: Subject to any disclaimer, the term of this patent is extended or adjusted under 35 U.S.C. 154(b) by 159 days.

(21) Appl. No.: 13/964,191

(22) Filed: Aug. 12, 2013

(65) Prior Publication Data

US 2015/0041621 A1 Feb. 12, 2015

(51) Int. Cl.

| | |
|---|---|
| ***F16M 1/00*** | (2006.01) |
| ***F16M 3/00*** | (2006.01) |
| ***F16M 5/00*** | (2006.01) |
| ***F16M 7/00*** | (2006.01) |
| ***F16M 9/00*** | (2006.01) |
| ***F16N 11/00*** | (2006.01) |
| ***F24C 15/30*** | (2006.01) |
| ***F24C 15/08*** | (2006.01) |

(52) U.S. Cl.

CPC ..... *F24C 15/30* (2013.01); *F24C 15/08* (2013.01)

(58) Field of Classification Search

CPC ..... F24C 15/30; F24C 11/00; F24C 15/18; Y10T 29/53; F16M 11/048; A47B 2210/0056; A47B 88/04; A47B 88/08; A47B 88/10; A47B 88/0407; A47B 88/16; A47B 81/00

See application file for complete search history.

(56) References Cited

U.S. PATENT DOCUMENTS

| | | | | |
|---|---|---|---|---|
| 5,779,333 | A * | 7/1998 | Lautenschlager | 312/334.15 |
| 5,785,397 | A * | 7/1998 | Pavelski | 312/111 |
| 5,926,886 | A | 7/1999 | Braunschweig et al. | |
| 7,296,863 | B2 * | 11/2007 | Lam et al. | 312/334.6 |
| 7,685,846 | B2 | 3/2010 | Hwang et al. | |
| 7,685,848 | B2 | 3/2010 | Jeong et al. | |
| 8,242,414 | B2 | 8/2012 | Hasslberger et al. | |
| 8,245,999 | B2 | 8/2012 | Tartan et al. | |
| 2006/0010934 | A1 | 1/2006 | Kim | |

(Continued)

OTHER PUBLICATIONS

Whirlpool, Wpro Stacking Kit with Shelf in White, Amazon.com, date first available on Amazon Jun. 21, 2011.

(Continued)

*Primary Examiner* — Brian D Mattei

(74) *Attorney, Agent, or Firm* — James E. Howard; Andre Pallapies

(57) ABSTRACT

A modular, multi-piece, domestic appliance combination unit includes a lower appliance; an upper appliance; a universal connector bracket attached to the upper appliance; a support bracket attached to the lower appliance, the support bracket having a plurality of attachment locations that are positioned relative to each other in the horizontal direction; a slide mechanism having an upper slide member fixed to the universal connector bracket, and a lower slide member fixed to the support bracket and slidably attached to the upper slide member. The upper appliance moves relative to the lower appliance in a direction perpendicular to the horizontal direction when the upper slide member moves relative to the lower slide member, and the support bracket is attachable to the lower slide member at different ones of the plurality of attachment locations such that the lower slide member is positionable at different locations along the horizontal direction.

12 Claims, 4 Drawing Sheets

(56) References Cited

U.S. PATENT DOCUMENTS

| | | | | |
|---|---|---|---|---|
| 2008/0124009 | A1* | 5/2008 | Peng et al. | 384/21 |
| 2008/0159670 | A1* | 7/2008 | Huang et al. | 384/18 |
| 2008/0284299 | A1* | 11/2008 | Chen et al. | 312/332 |
| 2009/0183360 | A1* | 7/2009 | Hasslberger et al. | 29/700 |
| 2009/0266949 | A1* | 10/2009 | Peay | 248/205.1 |
| 2012/0146475 | A1 | 6/2012 | Currle et al. | |
| 2014/0346941 | A1* | 11/2014 | Gasser et al. | 312/334.1 |
| 2015/0042221 | A1* | 2/2015 | Penuel | 312/236 |

OTHER PUBLICATIONS

Bosch, Bosch Axxis Washer and Dryer Stacking Kit w/Pull-out Tray, sears.com, accesses Mar. 25, 2013.

General Electric Corp., Stack Bracket Kit Installations Instructions, geappliances.com, accessed Mar. 22, 2013.

Ezee-fix, Washing Machine Stacking Kit, Ezee-fix.co.uk, accessed Mar. 22, 2013.

* cited by examiner

COMBINATION DOMESTIC APPLIANCE MOUNTING SYSTEM WITH SERVICE CAPABILITY

FIELD OF THE INVENTION

The invention is directed to a mounting system for stacked domestic appliances. More particularly, the invention is directed to a mounting system that allows an upper appliance to slide relative to a lower appliance to which it is attached.

An example of an application for the invention is a mounting system between two stacked domestic kitchen appliances that allows the upper appliance to be pushed back relative to the lower appliance while the appliances are still connected to each other in order to allow access to electronics or other serviceable parts of the lower appliance.

BACKGROUND OF THE INVENTION

In some modern kitchens, stacked, built-in, appliances are used to conserve space and to provide an aesthetically pleasing look. Such appliances can include, for example, conventional ovens, microwave ovens, steam ovens, warming drawers and storage drawers.

In these stacked combinations, the weight of an upper appliance is sometimes supported by the appliances below it. In the case of an upper appliance stacked on a lower appliance where both appliances have the same body width, it is relatively easy to transfer the weight of the upper appliance through the side walls of the lower appliance and to the ground. However, when the upper appliance has a body width that is less than the body width of the lower appliance, provision needs to be made in the lower appliance to transfer the weight of the upper appliance in such a way that the lower appliance is not deformed. In this situation, the weight of the upper appliance must be transferred to the outside structure of the lower appliance. This weight transfer is further complicated by the need to allow for upper appliances having different body widths.

In addition to the above described needs it is preferable, to reduce the cost and complexity of manufacture, to provide one support structure that can accommodate upper appliances of multiple different body widths.

It is desirable to reduce the complexity of products assembled in the factory by providing a modular design concept. This involves the individual products being offered to the consumer as a freestanding individual unit or as a combination unit which can include units stacked on top of each other. The varying widths of the upper appliances (for example, microwave ovens and steam ovens) also cause additional support to be required when attached to a lower appliance having a standard width.

Domestic appliances often have a service area located on top of the appliance that includes control electronics and other serviceable devices. In the case of the lower appliance, is often necessary to remove the upper appliance from the lower appliance to gain access to the lower appliance's service area. In the case of built-in appliance combination units, this requires the entire combination unit to be removed from the cabinet and then the upper appliance to be removed from the lower appliance. Because stacked appliance combination units can be extremely heavy, it is often difficult for one service technician to completely remove the combination unit from the cabinet in which it is installed. As a result, typical service calls can require two technicians to pull the combination unit out of the cabinet and to push it back into the cabinet, but typically only one technician is needed to actually perform the diagnostics and repairs.

In light of the above, there is a need for a mounting system and universal support structure for a combination unit that (1) allows access to the service area of the lower appliance without having to completely remove the combination unit from its cabinet, and (2) can properly transfer the weight of upper appliances having varying widths such that the weight of the upper appliance is transferred to structural members of the lower unit that exist at the outside areas of the lower unit.

SUMMARY

The invention achieves the benefit of providing a universal support structure for a combination domestic appliance unit that can properly transfer the weight of upper appliances having varying widths to the support members of the lower appliance. The invention also achieves the benefit of providing a sliding connection between the upper and lower appliances that allows servicing of the lower appliance without having to completely remove the combination unit from the cabinet in which it is installed.

The function of the inventive mounting system is to facilitate the attachment of a modular upper appliance (for example, a microwave oven or a steam oven) to a lower appliance (for example, a single wall oven) to result in a combination unit. Also included in the design of this mounting system is a feature which allows the entire combination unit to be slid out of the cabinet a short distance and the top appliance slid back to allow a service technician access to perform diagnostic testing and/or replacement of the lower appliance electronic controls without having to completely remove the combination appliance unit from the wall.

The mounting system can utilize a universal mounting bracket to attach the upper appliance to the lower appliance. In addition, a support bracket is provided to accept upper appliances of different widths and transfer the weight of the upper appliance to the support members of the lower appliance that usually exist at the perimeter of the lower appliance. To allow the desired front to rear relocation of the upper appliance relative to the lower appliance for service accessibility, a slide mechanism is attached between the universal mounting bracket attached to the upper appliance and the support bracket attached to the lower appliance. The slide mechanism preferably includes stop features that limit the extent of the sliding of the upper appliance relative to lower appliance.

Particular embodiments of the invention are directed to a modular, multi-piece, domestic appliance combination unit having a front face and a width in a horizontal direction across the front face. The combination unit includes a lower appliance; an upper appliance mounted on top of the lower appliance; a first universal connector bracket fixedly attached to the upper appliance; a first support bracket fixedly attached to the lower appliance, the first support bracket having a first plurality of attachment locations that are positioned relative to each other in the horizontal direction; a first slide mechanism having an upper slide member fixedly attached to the first universal connector bracket, and a lower slide member fixedly attached to the first support bracket and slidably attached to the upper slide member. The upper appliance is positionally fixed relative to the upper slide member of the first slide mechanism, the lower appliance is positionally fixed relative to the lower slide member of the first slide mechanism, the upper appliance moves relative to the lower appliance in a direction perpendicular to the horizontal direction when the upper slide member of the first slide mechanism moves relative to the lower slide member of the first slide mechanism, and the first support bracket is adapted to be attached to the lower slide member of the first slide mechanism at different ones of the first plurality of attachment locations such that the lower slide member of the first slide mechanism is positionable at different locations along the horizontal direction.

Other embodiments of the invention are directed to a connection structure for a modular, multi-piece, domestic appliance combination unit having a front face and a width in a horizontal direction across the front face, the combination unit having a lower appliance and an upper appliance mounted on top of the lower appliance. The connection structure includes a first universal connector bracket adapted to fixedly attach to the upper appliance; a first support bracket adapted to fixedly attach to the lower appliance, the first support bracket having a first plurality of attachment locations that are positioned relative to each other in the horizontal direction; a first slide mechanism having an upper slide member fixedly attached to the first universal connector bracket, and a lower slide member fixedly attached to the first support bracket and slidably attached to the upper slide member. The first support bracket is adapted to be attached to the lower slide member of the first slide mechanism at different ones of the first plurality of attachment locations such that the lower slide member of the first slide mechanism is positionable at different locations along the horizontal direction.

BRIEF DESCRIPTION OF THE DRAWINGS

The following figures form part of the present specification and are included to further demonstrate certain aspects of the disclosed features and functions, and should not be used to limit or define the disclosed features and functions. Consequently, a more complete understanding of the exemplary embodiments and further features and advantages thereof may be acquired by referring to the following description taken in conjunction with the accompanying drawings, wherein.

DETAILED DESCRIPTION

The invention is described herein with reference to the accompanying drawings in which exemplary embodiments of the invention are shown. The invention may, however, be embodied in many different forms and should not be construed as limited to the embodiments set forth herein.

As explained above, embodiments of the invention provide a universal support structure for a combination domestic appliance unit that can properly transfer the weight of upper appliances having varying widths to the support members of the lower appliance. The invention also achieves the benefit of providing a sliding connection between the upper and lower appliances that allows servicing of the lower appliance without having to completely remove the combination unit from the cabinet in which it is installed.

Figure 1:
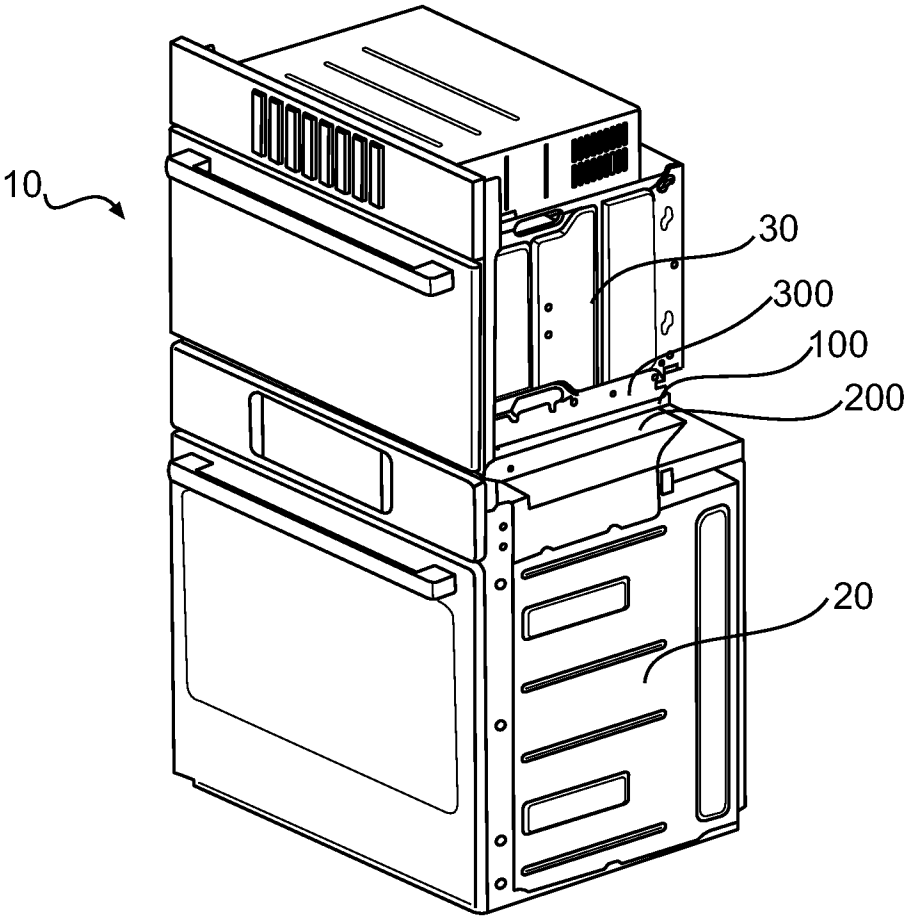
FIG. 1 is a perspective view of a combination appliance unit in accordance with embodiments of the invention.

FIG. 1 shows an example of a combination domestic appliance unit 10 having a lower appliance 20 (such as, for example, a built-in conventional oven) and an upper appliance 30 (such as, for example, a microwave oven or a steam oven). Lower appliance 20 and upper appliance 30 are attached to each other by way of, in this example, two support brackets 200 that are fixed to lower appliance 20, two universal connector brackets 300 that are fixed to upper appliance 30, and two slide mechanisms 100 that attach support brackets 200 to universal connector brackets 300.

Figure 2:
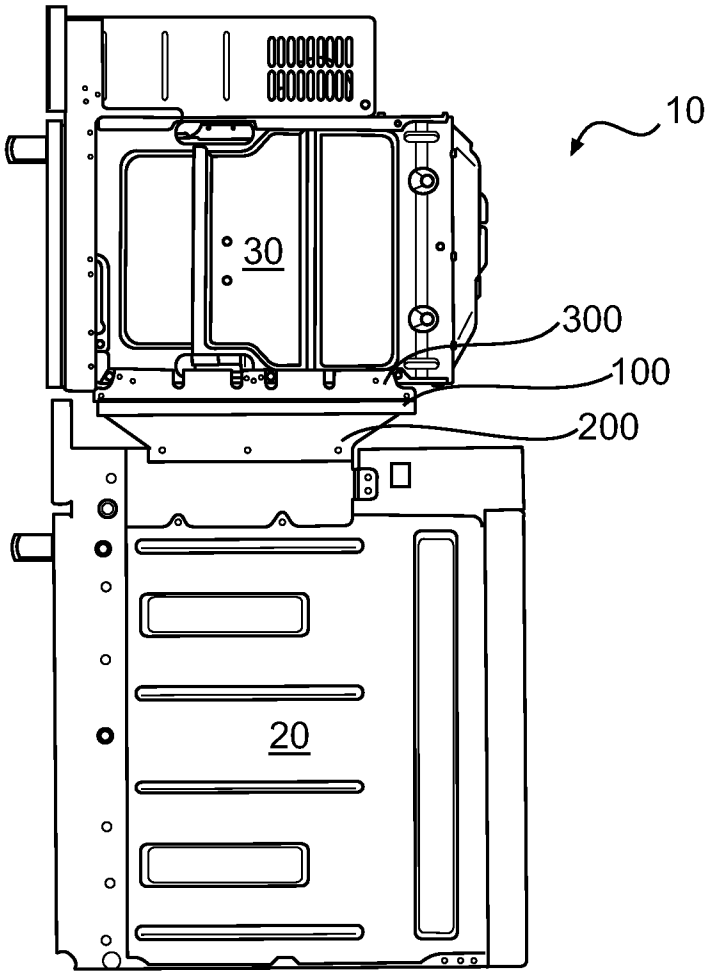
FIG. 2 is a side view of the embodiment shown in FIG. 1.

FIG. 2 is a side view of the exemplary embodiment of FIG. 1.

Figure 3:
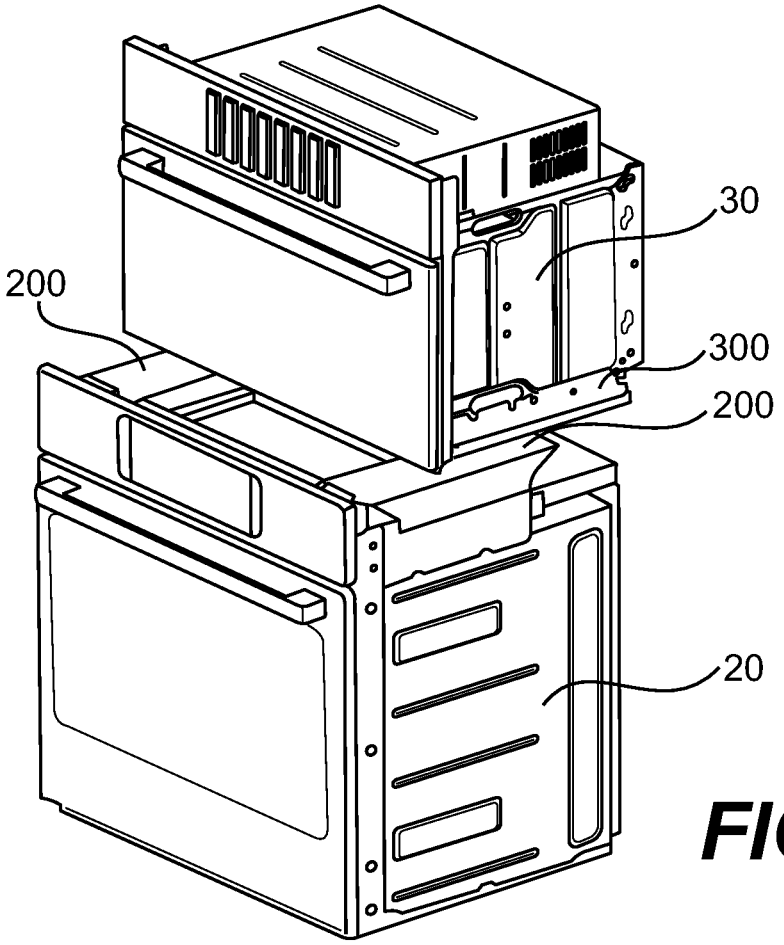
FIG. 3 is a perspective view of the embodiment shown in FIG. 1 with the service area exposed.
Figure 4:
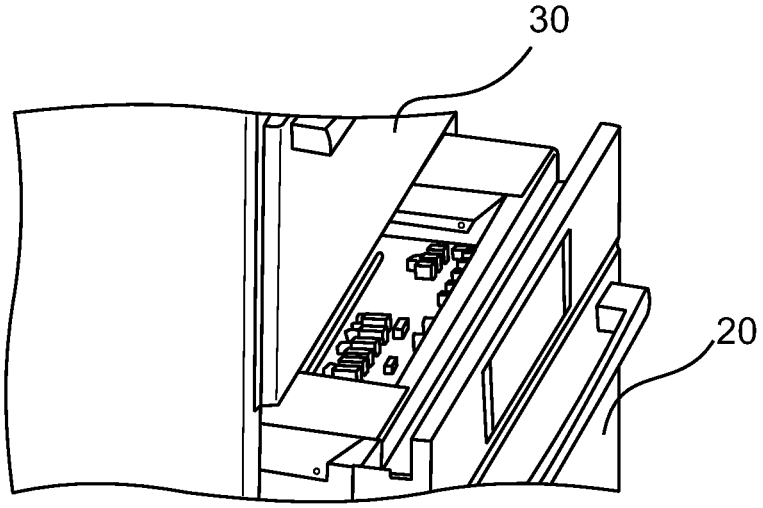
FIG. 4 is a perspective view of the embodiment shown in FIG. 1 with the service area exposed.

FIG. 3 is a perspective view of the exemplary embodiment of FIGS. 1 and 2 showing upper appliance 30 in a rearward position relative to lower appliance 20. In this position, slide mechanisms 100 are in an extended position such that universal connector brackets 300 have moved rearward relative to support brackets 200, compared to the position of upper appliance 30 shown in FIGS. 1 and 2. In practice, a service technician will slide the combination unit 10 out of the cabinet in which is located a distance equal to, or slightly more than, the distance which upper appliance 30 can slide rearward on slide mechanisms 100. This distance can be, for example, six to ten inches and is preferably a distance that does not move the center of gravity of combination unit 10 forward of the face of the cabinet. As a result, accommodation unit 10 can be pulled forward this distance without tilting forward and out of the cabinet. Once combination unit 10 has been pulled forward this distance, the service technician can remove a locking device (for example locking screw 130 shown in FIG. 7) to allow slide mechanism 100 to operate freely and then push upper appliance 30 rearward to expose an electronic devices area on an upper region of lower appliance 20. FIG. 4 shows the electronic devices area of lower appliance 20. The electronic devices area is only visible and accessible when upper appliance 30 is in a rearward position relative to lower appliance 20.

Figure 5:
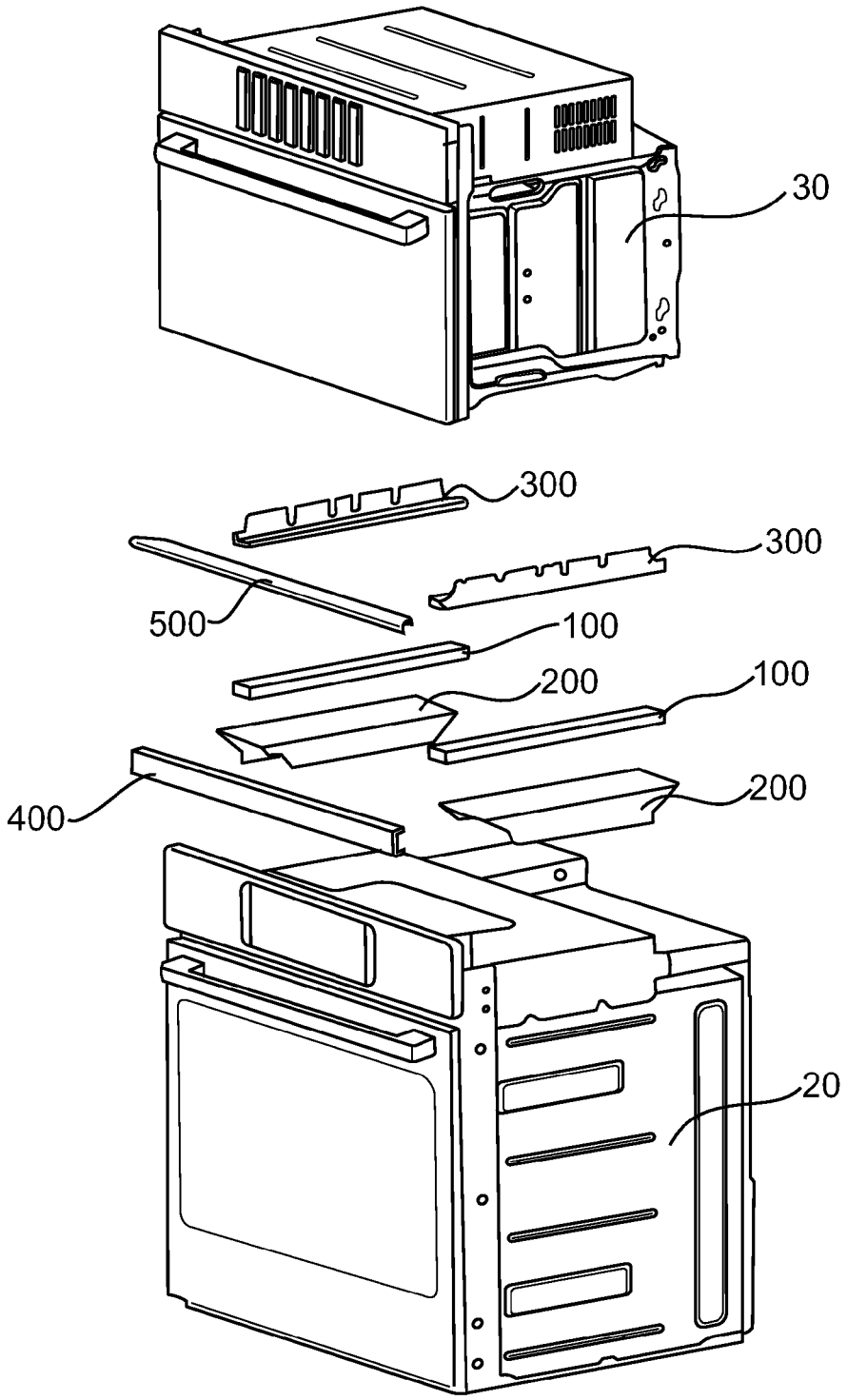
FIG. 5 is an exploded perspective view of the embodiment shown in FIG. 1.

FIG. 5 is an exploded view of the exemplary embodiment being discussed. In addition to the elements already discussed, FIG. 5 shows a top cross support bracket 400 that attaches to the front sections of support brackets 200, and a decorative trim 500.

Figure 6:
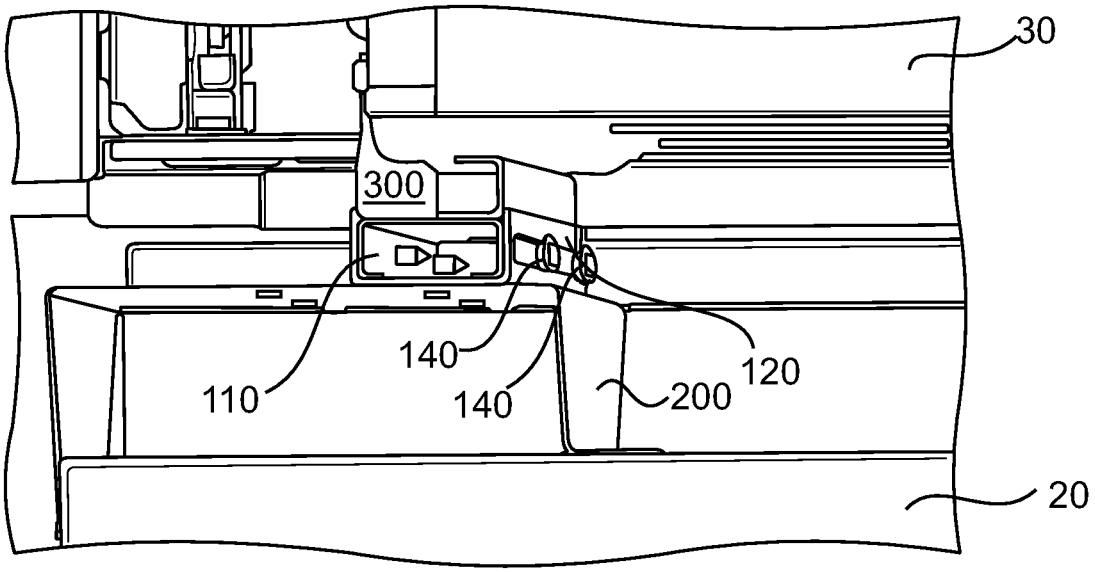
FIG. 6 is a partial perspective view of a slide mechanism in accordance with embodiments of the invention.

FIG. 6 shows a more detailed view of slide mechanism 100, support bracket 200 and universal connector bracket 300. Slide mechanism 100 includes an upper slide member 110 and a lower slide member 120 that slide relative to each other and are connected by, in this example, four slide connectors (such as, for example, shoulder bolts or shoulder screws) 140. Universal connector bracket 300 is fixedly attached to upper slide member 110 so that universal connector bracket 300 moves with upper slide member 110. Support bracket 200 is fixedly attached to lower slide member 120 and fixedly attached to lower appliance 20 such that lower slide member 120 is held stationary relative to lower appliance 20. In this example, upper appliance 30 has a particular width and, as such, lower slide member 120 is attached to support bracket 200 at an inward location by way of an inward set of attachment points, or holes. As can be seen in FIG. 6, a second set of attachment points, or holes, are provided in support bracket 200 and are appropriate for use when an alternate upper appliance having a greater width than upper appliance 30 is used.

Figure 7:
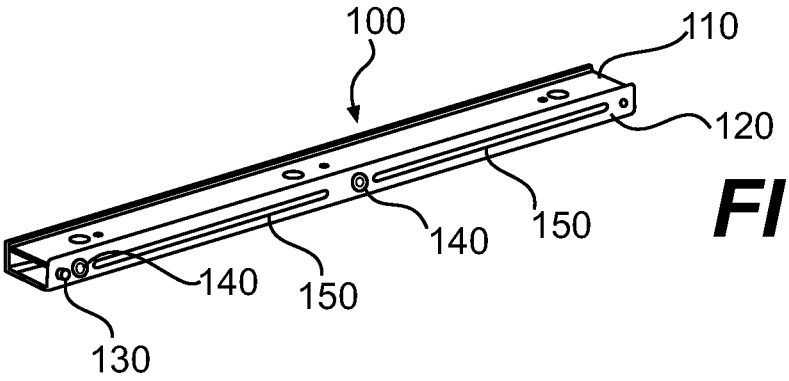
FIG. 7 is a perspective view of a slide mechanism in accordance with embodiments of the invention shown in a retracted position.
Figure 8:
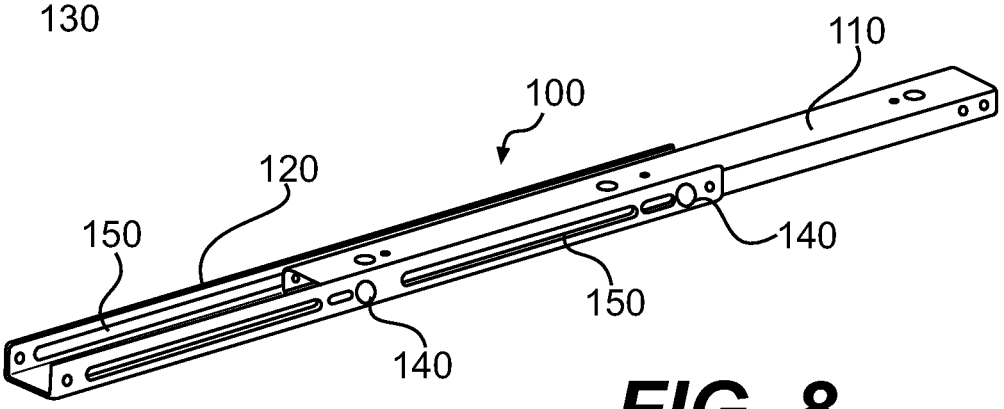
FIG. 8 is a perspective view of the slide mechanism of FIG. 7 shown in an extended position.

FIGS. 7 and 8 show slide mechanism 100 in a retracted position and in an extended position, respectively. As can be seen from FIGS. 7 and 8, slide connectors 140 ride in slots 150 in the sides of lower slide member 120 to permit upper slide member 110 to slide relative to lower slide member 120. At the same time, slide connectors 140 limit the extent of travel of upper slide member 110 relative to lower slide member 120. It is noted that while in this example upper slide member 110 rides in a channel of lower slide member 120, the reverse relationship can alternatively exist. Also shown in FIG. 7 is a locking screw 130 that is used to lock the upper and lower slide members relative to each other to ensure that upper appliance 30 does not move relative to lower appliance 20 except when such movement is desirable.

The exemplary embodiment of the invention described above provides the consumer a compact connection kit for connecting different modular cooking appliances together in a combination unit at the point of use of the appliances. These exemplary embodiments also provide precise location and fixation for maintaining gaps and alignment of different modular cooking appliances when connected together in a combination unit at the point of use of the appliances. Without the invention, it can be very difficult to properly connect and align appliances of a combination unit at the point of use of the appliances such as, for example, a residential kitchen. The exemplary embodiments also provide easy access for service technicians to perform diagnostic tests and repair or replace electronic components or other serviceable devices of the appliance without having to entirely remove the combination unit from its mounted location. This reduces the possibility of causing damage to the appliance or other surrounding appliances or cabinetry.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the invention.

What is claimed is:

1. A modular, multi-piece, domestic appliance combination unit having a front face and a width in a horizontal direction across the front face, the combination unit comprising:

a lower appliance;

an upper appliance mounted on top of the lower appliance;

a first universal connector bracket fixedly attached to the upper appliance;

a first support bracket fixedly attached to the lower appliance, the first support bracket having a first plurality of attachment locations on the first support bracket that are positioned relative to each other in the horizontal direction;

a first slide mechanism having an upper slide member fixedly attached to the first universal connector bracket, and a lower slide member fixedly attached to the first support bracket and slidably attached to the upper slide member of the first slide mechanism;

a second universal connector bracket fixedly attached to the upper appliance, the second universal connector bracket being identical to the first universal connector bracket;

a second support bracket fixedly attached to the lower appliance, the second support bracket having a first plurality of attachment locations on the second support bracket that are positioned relative to each other in the horizontal direction; and a second slide mechanism having an upper slide member fixedly attached to the second universal connector bracket, and a lower slide member fixedly attached to the second support bracket and slidably attached to the upper slide member of the second slide mechanism, wherein the upper appliance is positionally fixed relative to the upper slide member of the first slide mechanism, and the upper appliance is positionally fixed relative to the upper slide member of the second slide mechanism, the lower appliance is positionally fixed relative to the lower slide member of the first slide mechanism, and the lower appliance is positionally fixed relative to the lower slide member of the second slide mechanism, the upper appliance moves relative to the lower appliance in a direction perpendicular to the horizontal direction when the upper slide member of the first slide mechanism moves relative to the lower slide member of the first slide mechanism, the first support bracket is adapted to be attached to the lower slide member of the first slide mechanism at different ones of the first plurality of attachment locations such that the lower slide member of the first slide mechanism is positionable at different locations along the horizontal direction, the second support bracket is adapted to be attached to the lower slide member of the second slide mechanism at different ones of the first plurality of attachment locations such that the lower slide member of the second slide mechanism is positionable at different locations along the horizontal direction, the lower appliance further comprises an electronic devices area that is accessible from a front of the combination unit when the upper appliance is moved relative to the lower appliance in a direction away from a front face of the lower appliance, and the electronics devices area is inaccessible from the front of the combination unit when a front face of the upper appliance is aligned with the front face of the lower appliance.

2. The combination unit of claim 1, wherein the first slide mechanism further comprises a travel stop that limits relative travel between the upper and lower slide members of the first slide mechanism.

3. The combination unit of claim 2, wherein the travel stop prevents the upper appliance from moving backwards relative to the lower appliance more than a predetermined distance.

4. The combination unit of claim 3, wherein the predetermined distance is less than a distance that would cause the center of gravity of the combination unit to be located horizontally outside of the perimeter of the lower appliance.

5. The combination unit of claim 2, wherein the lower slide member of the first slide mechanism has a plurality of slots in sides of the lower slide member of the first slide mechanism, and the upper slide member of the first slide mechanism has a plurality of protrusions that extend horizontally from sides of the upper slide member of the first slide mechanism and engage the slots.

6. The combination unit of claim 5, further comprising a locking device that locks the upper and lower slide members of the first slide mechanism together such that they cannot move relative to each other.

7. A connection structure for a modular, multi-piece, domestic appliance combination unit having a front face and a width in a horizontal direction across the front face, the combination unit having a lower appliance and an upper appliance mounted on top of the lower appliance, the connection structure comprising:

a first universal connector bracket adapted to fixedly attach to the upper appliance;

a first support bracket adapted to fixedly attach to the lower appliance, the first support bracket having a first plurality of attachment locations on the first support bracket that are positioned relative to each other in the horizontal direction;

a first slide mechanism having an upper slide member fixedly attached to the first universal connector bracket, and a lower slide member fixedly attached to the first support bracket and slidably attached to the upper slide member;

a second universal connector bracket adapted to fixedly attach to the upper appliance, the second universal connector bracket being identical to the first universal connector bracket;

a second support bracket adapted to fixedly attach to the lower appliance, the second support bracket having a first plurality of attachment locations on the second support bracket that are positioned relative to each other in the horizontal direction; and a second slide mechanism having an upper slide member fixedly attached to the second universal connector bracket, and a lower slide member fixedly attached to the second support bracket and slidably attached to the upper slide member of the second slide mechanism, wherein the first support bracket is adapted to be attached to the lower slide member of the first slide mechanism at different ones of the first plurality of attachment locations such that the lower slide member of the first slide mechanism is positionable at different locations along the horizontal direction, the second support bracket is adapted to be attached to the lower slide member of the second slide mechanism at different ones of the first plurality of attachment locations such that the lower slide member of the second slide mechanism is positionable at different locations along the horizontal direction, the connection structure is configured to attach to a lower appliance having an electronic devices area that is accessible from a front of the combination unit when the upper slide member is moved relative to the lower slide member in a direction away from a front of the combination unit, and the electronics devices area is made inaccessible from the front of the combination unit when the upper slide member is in a fully forward position relative to the lower slide member.

8. The connection structure of claim 7, wherein the first slide mechanism further comprises a travel stop that limits relative travel between the upper and lower slide members of the first slide mechanism.

9. The connection structure of claim 8, wherein the travel stop prevents the upper slide member of the first slide mechanism from moving backwards relative to the lower slide member of the first slide mechanism more than a predetermined distance.

10. The connection structure of claim 9, wherein the predetermined distance is less than a distance that would cause the center of gravity of the combination unit to be located horizontally outside of the perimeter of the lower appliance.

11. The connection structure of claim 8, wherein the lower slide member of the first slide mechanism has a plurality of slots in sides of the lower slide member of the first slide mechanism, and the upper slide member of the first slide mechanism has a plurality of protrusions that extend horizontally from sides of the upper slide member of the first slide mechanism and engage the slots.

12. The connection structure of claim 11, further comprising a locking device that locks the upper and lower slide members of the first slide mechanism together such that they cannot move relative to each other.

* * * * *